United States Patent [19]

Watkins

[11] Patent Number: 4,800,828

[45] Date of Patent: Jan. 31, 1989

[54] DOUBLE NEEDLE BAR LOOP PILE TUFTING APPARATUS

[75] Inventor: Charles W. Watkins, Ooltewah, Tenn.

[73] Assignee: Tuftco Corporation, Chattanooga, Tenn.

[21] Appl. No.: 150,759

[22] Filed: Feb. 1, 1988

[51] Int. Cl.[4] ..... D05C 15/22

[52] U.S. Cl. ..... 112/80.41; 112/80.52

[58] Field of Search ..... 112/80.41, 80.51, 80.52, 112/80.53

[56] References Cited

U.S. PATENT DOCUMENTS

| | | | |
|---|---|---|---|
| 2,889,791 | 6/1959 | Fedevich | 112/80.52 |
| 3,396,687 | 8/1968 | Nowicki | 112/80.41 |
| 4,193,359 | 3/1980 | Beasley | 112/80.53 |
| 4,366,761 | 1/1983 | Card | 112/80.41 |

*Primary Examiner*—Ronald Feldbaum

*Attorney, Agent, or Firm*—Harrington A. Lackey

[57] ABSTRACT

A multiple needle tufting machine incorporating a pair of relatively transversely adjustable front and rear needle bars, each needle bar supporting corresponding front and rear needles in transverse rows for simultaneous penetration of a base fabric moving in a feeding direction through the machine. A looper apparatus is provided incorporating transversely adjustable front and rear loop pile hook bars supporting a plurality of corresponding front and rear loop pile hooks pointing in the direction of fabric feed. Both the front and rear needle bars and the front and rear hook bars are relatively transversely adjustable between positions in which the front and rear needles are in alignment with the direction of fabric feed and a staggered position in which the front and rear needles are transversely offset. Separate yarns of preferably different characteristics are fed to the front needles and to the rear needles preferably by pattern control mechanisms to produce loop pile fabric of various patterns.

12 Claims, 3 Drawing Sheets

DOUBLE NEEDLE BAR LOOP PILE TUFTING APPARATUS

BACKGROUND OF THE INVENTION

This invention relates to a multiple needle tufting machine for forming loop pile, and more particularly to a tufting machine incorporating double needle bars and double hook bars.

Multiple needle tufting machines having in-line needles and corresponding loop pile hooks for making loop pile are well known in the art. Moreover, multiple needle tufting machines having staggered needles and correspondingly staggered loop pile hooks are also known in the art.

It is also known in the tufting art to provide pattern attachments for loop pile tufting machine in order to produce tufted patterns having loop pile of different heights.

The Fedevich U.S. Pat. No. 2,889,791, issued June 9, 1959, discloses a "Loop Fabric Stitching Machine" incorporating a front transverse needle bar and a rear transverse needle bar, each supporting corresponding front and rear needles. Although each row of front needles and each row of rear needles in the Fedevich patent is transversely aligned, nevertheless, the front needles are staggered relative to the rear needles. Fedevich further discloses a plurality of transversely aligned front and rear loop pile hooks adapted to cooperate with the corresponding front and rear needles. However, the front and rear hooks or loopers are mounted on corresponding front and rear hook bars, each supported on a separate reciprocable hook shaft so that two hook bars and two hook shafts are required to drive the corresponding front and rear loopers.

The Gebert U.S. Pat. No. 3,025,807, issued Mar. 20, 1962, discloses front and rear needle carriers supporting corresponding needles for alternate penetration of a rearward moving base fabric. Front cut pile hooks and rear loop pile hooks are mounted in transverse rows on a single bracket supported on the same hook shaft or rock shaft for reciprocating the corresponding hooks to alternately engage the corresponding front and rear needles in order to form a front transverse row of cut pile and a rear transverse row of loop pile. Gebert also discloses fabrics in which the cut pile and loop pile are formed at different heights, some of which overlap each other in order to form different patterns.

The Rodstein et al U.S. Pat. No. 3,402,686, issued Sept. 24, 1968, discloses a tufting machine incorporating transverse front and rear needle bars supporting corresponding front and rear needles for simultaneous penetration of the base fabric. A unitary looper incorporating a pair of cut pile hooks longitudinally spaced in the direction of the fabric feed is mounted on a single reciprocable hook shaft for simultaneous cooperation of the double hooks with the front and rear needles in order to simultaneously form in the base fabric a pair of transverse rows of, longitudinally spaced cut pile tufts. The front and rear needles disclosed in the Rodstein patent are longitudinally aligned in the direction of fabric feed, as well as being transversely aligned in their respective front and rear rows.

However, none of the above patents, or other prior art known to the Applicant, includes a pair of front and rear transverse needle bars and a pair of corresponding front and rear hook bars adapted to be adjusted relative to each other in a direction transverse to the direction of the fabric feed, to simultaneously form a front row of loop pile and a rear row of loop pile in which the loops are either in longitudinal alignment in the direction of the fabric feed, or are staggered, depending upon the adjustment of the respective needle bars and hook bars.

SUMMARY OF THE INVENTION

It is therefore an object of this invention to provide a multiple needle tufting machine capable of simultaneously forming double transverse rows of loop pile tufts which are either in longitudinal alignment with the fabric feed or are staggered.

Another object of this invention is to provide in a multiple needle tufting machine a pair of transversely adjustable front and rear needle bars supporting corresponding rows of front and rear needles and a transversely adjustable pair of hook bars mounted on the same hook shaft and supporting transversely spaced front hooks and rear hooks adapted to cooperate with the corresponding front and rear needles for the formation of a pair of transverse rows of loop pile.

It is also an object of this invention to provide a multiple needle loop pile tufting machine incorporating a pair of transversely adjustable front and rear needle bars and front and rear hook bars in combination with separate yarn feed mechanisms for feeding front yarns of the characteristic, such as color, to the corresponding front needles and rear yarns of a different characteristic to the rear needles. Furthermore, pattern control attachments may also be provided to control and vary the height of the loop pile tufts in each transverse row of loop pile as well as the loop pile tufts in the same row of stitching.

Thus, the combination of a pair of front and rear transversely adjustable needle bars and corresponding transversely adjustable hook bars to either align or stagger needles and hooks in the direction of fabric feed, as well as the differences in characteristics, such as color, between the front and rear yarns, and the independent pattern controlled mechanism to vary the pile height in each loop stitch in the same and/or different rows of tufting, present a multitude of options to produce tufted loop pile fabrics of varying patterns.

Another object of this invention is to provide a tufting machine capable of producing loop pile fabric having two-color patterns by the "buried end" technique of concealing low loops of one color with high loops of another color, either in longitudinal rows, or staggered rows of stitching, in one-half the gauge of a conventional machine having a single needle bar and a single hook bar, in order to substantially double the yarn density of the fabric.

It is another object of this invention to provide a multiple needle loop pile tufting machine incorporating double needle bars and hook bars in which either or both the needle bars may be transversely, slidably mounted for laterally shifting either needle bar in accordance with a predetermined pattern.

It is a further object of this invention to provide a multiple needle loop pile tufting machine incorporating double needle bars and double hook bars in which the needles of the front needle bar tuft a plain (uniform height) or sculptured (multi-height) solid-color loop pile fabric, and fewer, more widely spaced, needles in the rear needle bar insert accent tufts of another color into the fabric, while the rear needle bar is being laterally shifted.

In one embodiment of this invention, a set of front hooks may be utilized whose bills are predisposed at a slight elevation above the bills of the rear hooks to permit the loops shed from the front hooks to freely pass over the rear hooks during the movement of the base fabric through the loop pile tufting machine.

DESCRIPTION OF THE PREFERRED EMBODIMENTS

Figure 4:
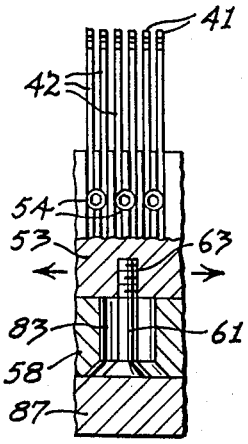
FIG. 4 is a fragmentary section taken along the line 4—4 of FIG. 3.
Figure 1:
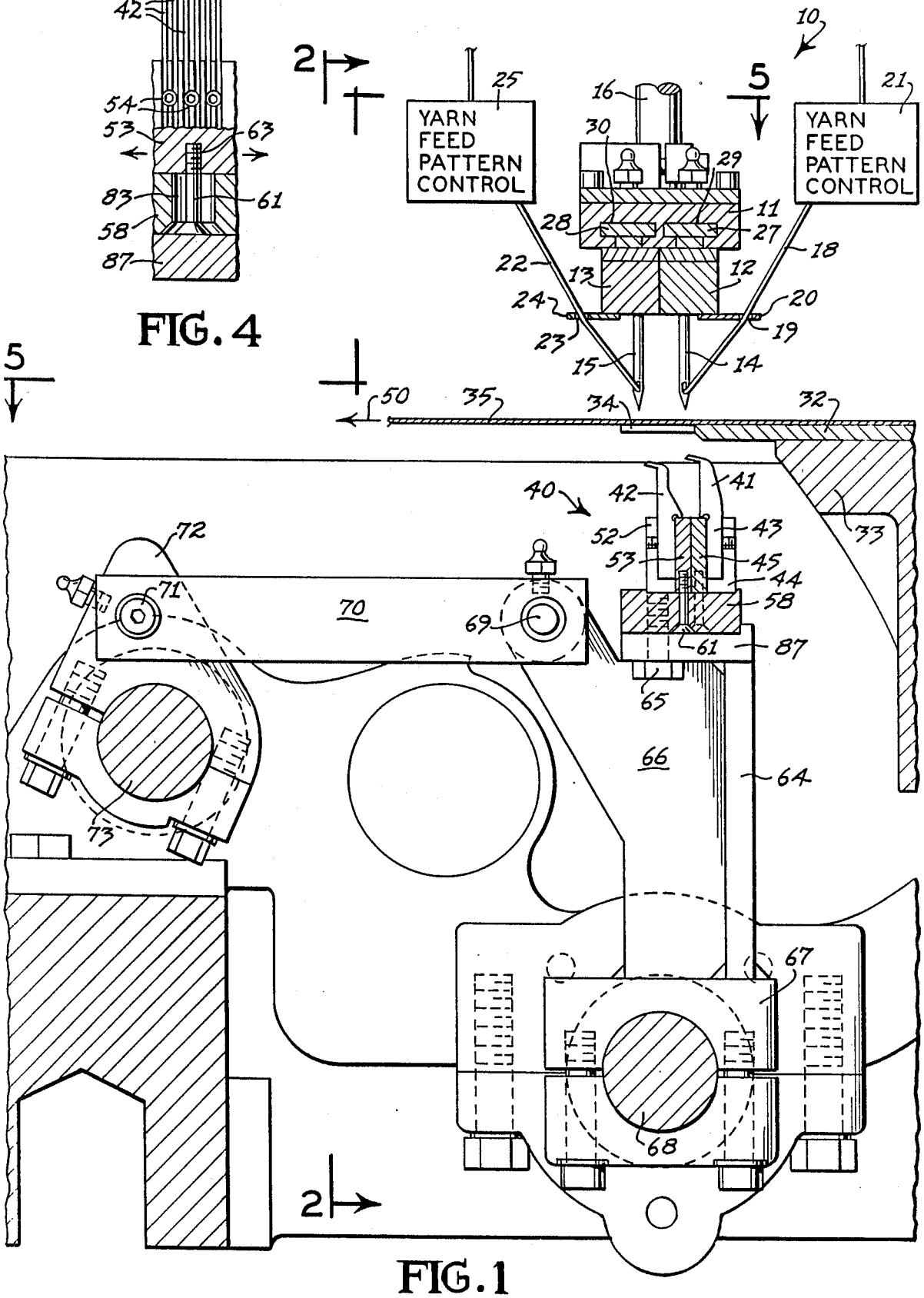
FIG. 1 is a fragmentary, sectional elevational view of a portion of a multiple needle tufting machine incorporating this invention, disclosing the needles and hooks in their retracted, inoperative position.
Figure 2:
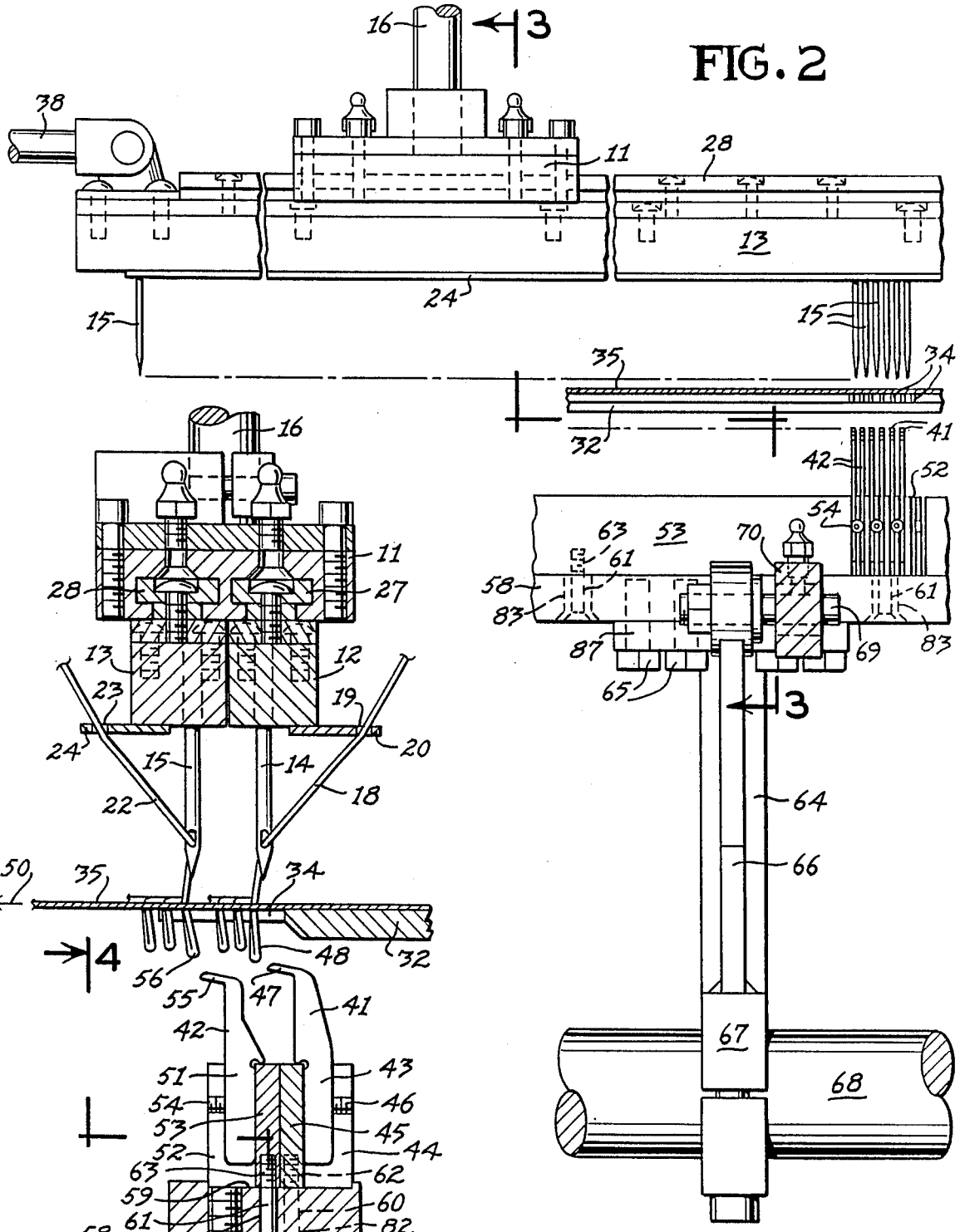
FIG. 2 is a rear sectional elevation taken along the line 2—2 of FIG. 1.

FIG. 1 discloses a multiple needle loop pile tufting machine 10 including a plurality of elongated transversely spaced needle bar carriers 11 supporting a front needle bar 12 and a rear needle bar 13. The front needle bar 12 supports a row of transversely spaced front needles 14, while the rear needle bar 13 supports a row of transversely spaced rear needles 15. Each needle bar carrier 11 is connected to a push rod 16 adapted to be vertically reciprocated by a conventional needle drive mechanism, not shown.

Front yarns 18 are supplied to the corresponding front needles 14 through corresponding apertures 19 in the front yarn guide plate 20 from a source of yarn supply, not shown, such as yarn feed rolls, creels, or other known yarn supply means. Preferably, the front yarns 18 pass through a yarn feed pattern control mechanism 21, graphically illustrated in FIG. 1, adapted to back-rob individual front yarns 18, in accordance with a pre-determined pattern. Any one of several pattern control mechanisms may be incorporated in the mechanism 21, such as those disclosed in U.S. Pat. Nos. 2,782,905 and 2,935,037.

In the same manner, rear yarns 22 are supplied to the corresponding rear needles 15 through corresponding apertures 23 in the rear yarn guide plate 24 from another source of supply for the yarns, not shown. Also in a preferred form of the invention, the rear yarns 22 are fed through a separate yarn feed pattern control mechanism 25 which may be independent of the yarn feed pattern control mechanism 21, in order to back-rob individual rear yarns 22 in order to produce loop pile loops of different heights or depths, depending upon the pre-determined pattern incorporated in the rear pattern control mechanism 25.

The front needle bar 12 and the rear needle bar 13 are preferably slidably mounted within the needle bar carriers 11 by the corresponding front and rear T-shaped slide plates 27 and 28 transversely slidably carried or mounted within the guideway channels 29 and 30. Each needle bar 12 and 13 may be transversely or laterally shifted independently of each other by appropriate pattern control means in a well known manner, such as the pattern controlled needle bar positioner mechanism 36 through corresponding push rods 37 and 38 connected to the respective front needle bar 12 and rear needle bar 13.

Supported upon the front needle plate 32 and fixed to the bed frame 33 are a plurality of straight rearward projecting, transversely spaced, needle plate fingers 34, which project rearward between the vertical needle paths of the reciprocable front and rear needles 14 and 15.

Supported for longitudinal rearward movement over the needle plate 32 is the base fabric 35.

The needle drive mechanism, not shown, is designed to actuate the push rods 16 to vertically reciprocate the pair of needle bars 12 and 13 to cause the front and rear needles 14 and 15 to simultaneously penetrate the base fabric 35 far enough to carry the respective yarns 18 and 22 through the base fabric 35 to form loops therein. After the loops are formed, the needles 14 and 15 are vertically withdrawn to their elevated, retracted positions disclosed in FIGS. 1 and 3.

The looper apparatus 40 made in accordance with this invention includes a plurality of transversely spaced front loop pile hooks 41 and a plurality of transversely spaced rear loop pile hooks 42, there being one front loop pile hook 41 for each front needle 14, and one rear loop pile hook 42 for each rear needle 15.

Figure 3:
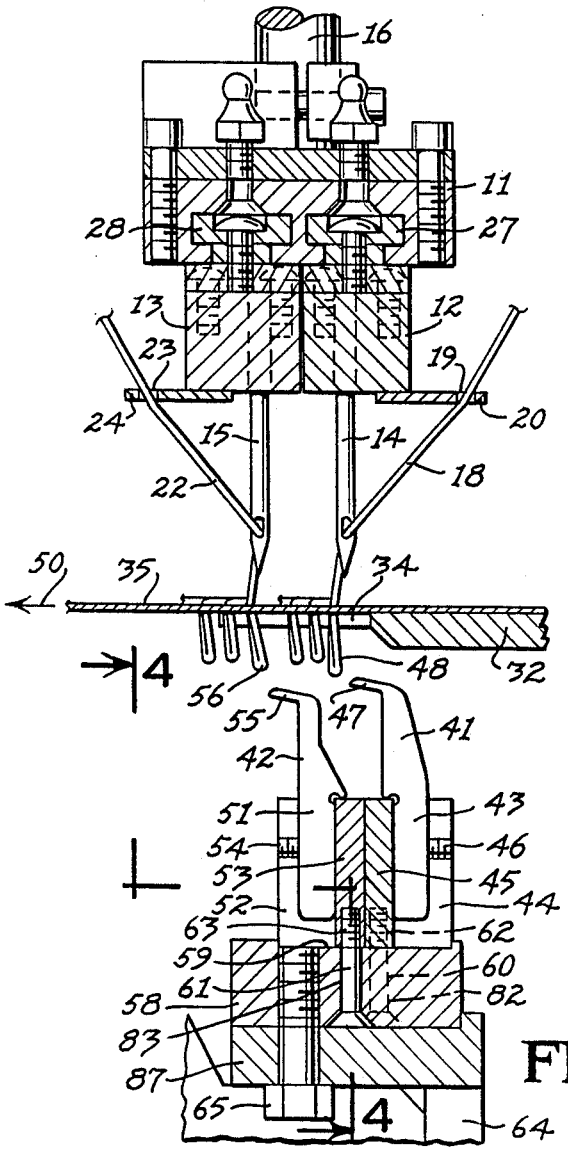
FIG. 3 is an enlarged fragmentary sectional elevation taken along the line 3—3 of FIG. 2, disclosing the formation of the loop pile tufts.

Each front loop pile hook 41 is provided with a shank 43 received in a corresponding slot 44 in a transverse front hook bar 45. The front hooks 41 are secured in the front hook bar slots 44 by corresponding set screws 46. The front loop pile hooks 41 have the same transverse spacing or gauge as the front needles 14 and are so arranged that the bill 47 of each front hook 41 is adapted to cross and engage its corresponding front needle 14 when the front needle 14 is in its lowermost position, in a well known manner, to seize the yarn 18 and form a front loop 48 therein (FIG. 3). The bills 47 of the front hooks 41 point rearward in the direction of fabric feed, as indicated by the arrow 50.

In a similar manner, each of the rear loop pile hooks 42 is provided with a shank 51 received in a corresponding vertical slot 52 in the rear hook bar 53. Each of the shanks 51 is retained in its corresponding slot 52 by a corresponding set screw 54. The rear hooks 42 have the same transverse spacing or gauge as the rear needles 15 and are so arranged that the bill 55 of each hook 42 is adapted to cross and engage its corresponding rear needle 15 when the rear needle 15 is in its lowermost position in a well known manner, as disclosed in FIG. 11, to seize the yarn 22 and form a rear loop 56 therein. The bills 55 of the rear loop pile hooks 42 point rearward in the same direction as the bills 47 and the fabric feed 50.

The front hook bar 45 and the rear hook bar 53 are independently mounted to extend longitudinally, but transversely of the direction of fabric feed 50, in an elongated hook mounting bar 58. The rear hook bar 53 is supported for independent slidable movement longitudinally of the hook mounting bar 58 and parallel to the front hook bar 45. As disclosed in the drawings, the rear surface of the front hook bar 45 and the front surface of the rear hook bar 53 are in sliding engagement with each other. The bottom portions of both hook bars 45 and 53 are slidably received within an elongated channel or recess 59 formed in the top surface of the hook mounting bar 58.

Figures 5, 6, 7, 8, 9, 10, 11:
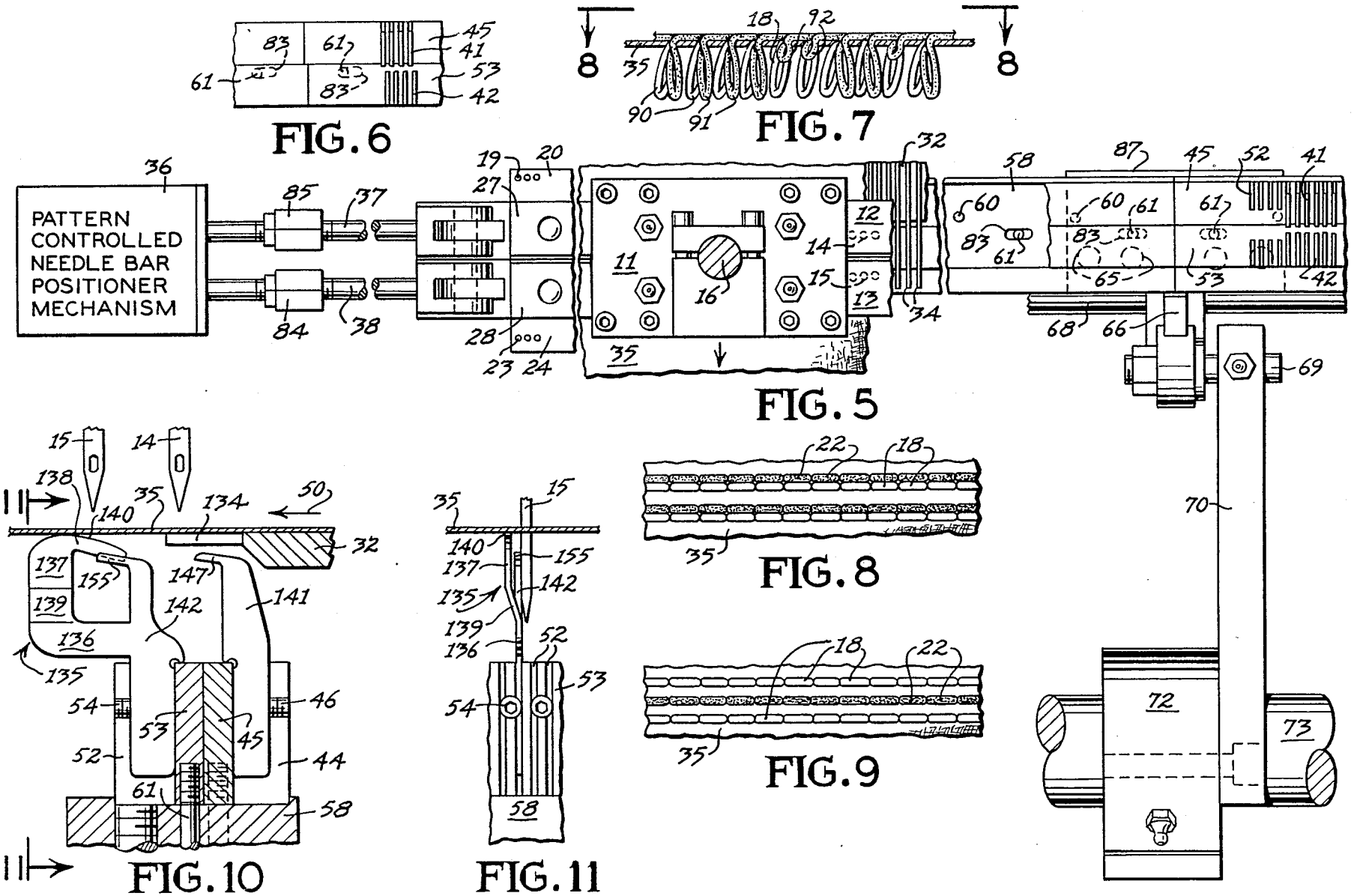
FIG. 5 is a fragmentary plan section taken along the line 5—5 of FIG. 1, with portions broken away, disclosing the front and rear needles in longitudinal alignment, and illustrating a needle bar positioner mechanism.
FIG. 6 is a fragmentary plan view of the hook bars disclosed in FIG. 5, in which the rear hook bar sections have been laterally moved to stagger the hooks.
FIG. 7 is a fragmentary sectional elevation of the base fabric illustrating longitudinal rows of loop pile stitching formed by front and rear needles and hooks in longitudinal alignment.
FIG. 8 is a fragmentary plan view of the base fabric taken along the line 8—8 of FIG. 7.
FIG. 9 is a fragmentary plan view of the base fabric, similar to FIG. 8, formed by staggered front and rear needles and hooks.
FIG. 10 is an enlarged fragmentary sectional elevational view of the apparatus illustrating a modified needle plate finger mounted on the rear hook, with the needles elevated.
FIG. 11 is a rear sectional elevation taken along the line 11—11 of FIG. 10, with the needles in their lowermost positions.

Each of the hook bars 45 and 53 are secured within the transverse recess 59 of the mounting bar 58 by a plurality of bolts 60 and 61 extending upwardly through the mounting bar 58 and into corresponding threaded bolt holes 62 and 63 in the respective hook bars 45 and 53. Each front bolt 60 extends through a hole 82 of substantially the same diameter as the bolt 60 within the mounting bar 58, so that when the front hook bar 45 is secured within the mounting bar 58 by its corresponding bolt 60, the front hook bar 45 will be in a relatively stationary position relative to the mounting bar 58. On the other hand, each of the rear bolts 61 extend upwardly through an oversize, or transversely elongated slot 83, as best disclosed in FIGS. 2, 4, 5, and 6. Each transversely elongated, slot 83 permits the rear hook bar 53 to be shifted or moved transversely a limited distance in order to position the rear hooks 42 in longitudinal alignment with the front hooks 41 in the direction of fabric feed, or to shift the rear hooks 42 out of longitudinal alignment so that the rear hooks 42 are staggered relative to the front hooks 41. Preferably, the elongated slots 83 are utilized to position the rear hooks 42 either in longitudinal alignment with their corresponding front hooks 41, or in a staggered position in which the rear hooks 42, are equidistantly spaced between the front hooks 41, in a transverse direction, as illustrated in FIG. 6.

When the bolts 61 are loosened in their corresponding threaded holes 63 to permit the rear hook bars 53 to be transversely shifted, the rear needle bar 13 is also transversely shifted the same increment as the rear hook bar 53, so that the rear needles 15 are always in their same corresponding vertical relationship with their rear hooks 42 to seize the corresponding rear yarns 22 and form the rear loops 56. The rear needle bar 13 is transversely adjusted by turning the turnbuckle nut 84 in order to lengthen or shorten the corresponding push rod 38, as needed, in a well known manner. The push rod 37 is also provided with a turnbuckle nut 85 to lengthen or shorten the push rod 37, if desired. The turn-buckle nuts 84 and 85 are disclosed in FIG. 5 and are normally used in adjusting the length of the push rods 37 and 38 for determining the positions of the needle bars 12 and 13 when actuated by the pattern control needle bar positioner mechanism 36.

The transverse hook mounting bar 58 is fixed to the upper bracket ledge 87 of each bracket arm 64 by means of bolts 65. Each bracket arm 64 is rigidly secured, such as by welding, to a rocker arm 66, the lower end of which is fixed by a clamp bracket 67 to a transverse idler shaft 68. The angular upper end portion of the rocker arm 66 is connected by a pivot pin 69 to a link bar 70, the opposite end of which is connected by a pivot pin 71 to a radial arm 72 clamped to a driven looper shaft or jack shaft 73. The looper shaft 73 is driven or reciprocably rotated by conventional looper drive means, not shown, operatively connected to the needle drive mechanism which reciprocates the needle push rod 16 for synchronous movement.

Thus, it will be seen that when the driven looper shaft 73 is rotated in one direction, such as a clockwise direction in FIG. 1, the loop hooks will be moved forward to their inoperative positions before the needles 14 and 15 are reciprocated downwardly. Rotation of the looper shaft 73 in the opposite or counter-clockwise direction will cause the loop pile hooks 41 and 42 to move rearwardly toward their operative positions crossing the corresponding needles 14 and 15 in their lowermost positions to form the front loops 48 and the rear loops 56, respectively.

Although the needle plate fingers 34 usually satisfactorily support the base fabric 35 for penetration by all of the needles 14 and 15, sometimes, the length of the needle plate fingers creates a weakness in the fingers 34, particularly at their free ends where support is required for the base fabric 35 for penetration by the rear needles 15. Accordingly, shortened needle plate fingers 134 are utilized as disclosed in FIG. 10 to support the base fabric 35 in the vicinity of the front needles 14. Also, as disclosed in FIG. 10, the free ends of the fore-shortened needle plate fingers 134 project rearward slightly behind the axial paths of the needles 14.

In order to support the area of the base fabric 35 penetrated by the rear needles 15, a needle plate finger 135 is secured to each rear hook 142, by soldering, welding, or other means, but as disclosed in FIG. 10, is made an integral part of the hook 142. The needle plate finger 135 includes a mounting portion 136 secured to and projecting rearward from the hook 142. The finger 135 further includes an offset neck portion 137 and a finger portion 138 connected to the mounting portion 136 by an angular connecting portion 139. The finger portion 138 and neck portion are preferably coplanar and transversely offset from the looper hook 142 approximately a half gauge. The finger portion 138 preferably has an arcuate bearing surface 140 for supporting the bottom surface of the base fabric 35, and projects forward beside the rear looper bill 155. The arcuate bearing surface 140 is ideally a circular arc having a center coincident with the center of the idler shaft 68, so that the arcuate bearing surface 140 engages the bottom surface of the base fabric 35 at the same level, regardless of the arcuate movement of the rear hooks 142.

It will be noted in FIGS. 1 and 3 that each of the front hooks 41 has its rearward projecting bill 47 at an elevation above the bills 55 of the rear hooks 42. The purpose of the elevated bills 47 is to permit the loops caught and shed by the front hooks 41 to freely pass over the bills 55 of the rear loopers or hooks 42 so that the rear loops will not be caught, tagged, or wedged between the corresponding bills 55 of the rear hooks 42.

In FIG. 10, the front looper bill 147 may be at the same elevation as the rear looper bill 155, since the loops shed from the front loopers 141 will ride over the tops of the rear looper bills 155 and over the arcuate bearing surfaces 140 of the finger portions 138 of the needle plate fingers 135 without interfering with the rear loopers 142.

In the operation of the tufting machine 10 made in accordance with this invention, if it is desired that the rear needles 15 be in longitudinal alignment with their corresponding front needles 14, before the machine is started, the bolts 61 are unthreaded to a limited degree from their corresponding bolt holes 63 so that the rear hook bar 53 is loose and free to slide transversely to the limit of the length of the bolt slots 83. The respective hook bar sections 53 are shifted transversely within the recess 59 of the mounting bar 58 until the rear hooks 42 are longitudinally aligned with their corresponding front hooks 41. The bolt 61 is then tightened in the corresponding threaded hole 63 to lock the rear hook bar sections 53 in the mounting bar 58. The turnbuckle nut 84 is then rotated to shorten or lengthen the push rod 38, as required in order to position all of the rear needles 15 in longitudinal alignment with their corresponding front needles 14.

The yarn feed pattern control mechanisms 21 and 25 are then programed to back-rob certain front yarns 18 and rear yarns 22 in order to produce the desired high-low loop pile patterns. The yarns 18 and 22 are preferably of different colors for the respective needles 14 and 15. The machine 10 is then operated to produce the desired loop pile patterns in the base fabric 35 as the base fabric 35 moves in the direction of the arrow 50 rearwardly through the machine 10, as illustrated in FIG. 1.

One typical pattern for in-line needles 14 and 15 is disclosed in FIG. 7 in which the plain yarns 18 are stitched by the front needles 14 to form high loop pile loops 90 and the stippled yarns 22 are stitched by the rear needles 15 in order to form the respective high loop pile loops 91 and low loop pile loops 92. FIG. 8 discloses the top of the base fabric to illustrate the closeness of the pairs of yarns stitched by the respective front and rear in-line needles. Actually the yarns would be stitched upon each other, or across from one side or the other, depending upon the vibrations in the base fabric and the needles.

When it is desired to form patterns in which the front and rear loops are staggered, the machine is stopped, each bolt 61 is loosened again to loosen the rear needle hook bar sections 53. The hook bar sections 53 are then shifted in the desired transverse direction a half gauge so that each rear hook 42 lies longitudinally between a pair of front hooks 41, as illustrated in FIG. 6. The bolt 61 is then tightened to fix the staggered hooks 42 and 41, and the turnbuckle nut 84 is again turned to adjust the length of the push rod 38 so that the rear needles 15 will be staggered with respect to the front needles 14 and will be in the same vertical spatial relationship with the corresponding rear hooks 42 to form rear loop pile loops.

FIG. 9 is a fragmentary top plan view of the base fabric 35 in which staggered loops are formed by the front and rear needles with their corresponding front yarns 18 and rear yarns 22.

When it is desired to make even more complex patterns by shifting the needle bars 27 and 28, the pattern control needle bar positional mechanism 36 is actuated in a well-known manner to periodically transversely shift the needle bars 12 and 13 in a well known manner.

It is therefore apparent that a multiple needle tufting machine 10 has been designed for forming only loop pile, but which is capable of producing a great variety of patterns in the loop pile, not only by the conventional means of utilizing yarns of different color fed separately to front and rear needles, back-robbing certain yarns according to a predetermined pattern, shifting the needle bars periodically to provide zig-zag stitching, but also in having hook bars or hook bar sections which are capable of being shifted so that the rear needles are in longitudinal alignment with the front needles, or can be staggered relative to the front needles. Moreover, the front and rear hooks are mounted in separate hook bars which are carried by a single mounting bar for reciprocation by a single hook shaft so that the hooks 41 and 42, as well as the needles 14 and 15 are relatively close together and may be utilized in producing fine gauge patterned loop pile tufted fabric.

What is claimed is:

1. A tufting machine for the formation of loop pile, comprising:

(a) means for supporting a base fabric for longitudinal movement in a feeding direction from front-to-rear through the machine, (b) a front needle bar supporting a plurality of front needles spaced transversely of said feeding direction for introducing yarns through said base fabric to form loops, (c) a rear needle bar behind said front needle bar in said feeding direction and supporting a plurality of rear needles spaced transversely of said feeding direction for introducing yarns through said base fabric to form loops, (d) needle drive means supporting said needle bars for simultaneous reciprocal movement toward and away from said base fabric, (e) looper apparatus comprising a plurality of front loop pile hooks and a plurality of rear loop pile hooks, there being one hook for each of said needles, (f) said looper apparatus further comprising an elongated front hook bar supporting said front loop pile hooks spaced longitudinally of said front hook bar and an elongated rear hook bar supporting said rear loop pile hooks spaced longitudinally of said rear hook bar, (g) an elongated hook mounting bar and means mounting said front and rear hook bars longitudinally of and upon said hook mounting bar so that said front hook bar is in front of and parallel to said rear hook bar, (h) said looper apparatus further comprising reciprocal motive means including a transverse reciprocable hook shaft and means connecting said hook mounting bar to said hook shaft so that said loop pile hooks are spaced transversely of said feeding direction so that the bills of said loop pile hooks point in the same direction as said feeding direction and each of said front loop pile hooks cooperates with a corresponding front needle to form a front loop and each of said rear loop pile hooks cooperates with a corresponding rear needle to form a rear loop simultaneously with the formation of said front loops.

2. The invention according to claim 1 in which said hook mounting bar is provided with means for slidably receiving said hook bars for independent longitudinal movement relative to each other and to said hook mounting bar, and means for securing at least one of said hook bars in different longitudinally adjusted positions relative to said hook mounting bar, and further comprising an elongated needle mounting bar and means mounting said front and rear needle bars upon said needle mounting bar for longitudinal relative adjustment relative to each other and to said needle mounting bar.

3. The invention according to claim 2 in which said means mounting said needle bars in said needle mounting bar comprises means mounting said needle bars in a position in which said front and rear needles are aligned in said feeding direction, and said means mounting said hook bars upon said hook mounting bar comprises means supporting said hook bars in a fixed position in which said front and rear hooks are in alignment with said feeding direction and for cooperating with said corresponding front and rear needles.

4. The invention according to claim 2 in which said means mounting said needle bars upon said needle mounting bar comprise means mounting said needle bars in a fixed position in which said front and rear needles are staggered in the direction of said fabric feed, and said means mounting said hook bars is adapted to mount said hook bars on said hook mounting bar in a fixed position in which said front and rear hooks are staggered to cooperate with said corresponding staggered front and rear needles.

5. The invention according to claim 2 further comprising front yarn feed means for feeding a plurality of front yarns to said corresponding front needles, and separately rear yarn feed means for feeding a plurality of rear yarns to said corresponding rear needles.

6. The invention according to claim 5 in which at least one of said yarn feed means comprises yarn feed pattern control means for controlling the height of the loop pile loop formed by the corresponding yarn introduced into said fabric by said corresponding needle.

7. The invention according to claim 1 in which each of said loop pile hooks comprises a bill projecting in the direction of said fabric feed direction, the bills of said front loop pile hooks being located above the bills of said rear loop pile hooks to facilitate the passage of front loops formed in said fabric as they move in the fabric feed direction over said rear loop pile hooks.

8. The invention according to claim 1 in which said means for supporting a base fabric comprises a needle plate mounted above and in front of said rear loop pile hooks and further comprises a plurality of elongated straight needle plate fingers projecting rearwardly from said needle plate to positions adjacent and behind the reciprocable paths of said rear needles, said needle plate fingers projecting between the paths of said front needles and said rear needles.

9. The invention according to claim 1 in which said means for supporting a base fabric comprises a needle plate mounted in front of and above said rear loop pile hooks and further comprising a plurality of straight needle plate fingers projecting rearwardly from said needle plate between the reciprocable paths of said front needles and terminating in points in front of the paths of said rear needles, a rear needle plate finger for each rear needle comprising a finger portion, means fixing said finger portion upon each corresponding rear hook, said corresponding finger portion being offset transversely from said rear hook so that said finger portion lies substantially at the same level as said needle plate for supporting said base fabric as it moves beneath said rear needles, said finger portion lying between the reciprocable paths of said corresponding rear needles.

10. In a multiple needle loop pile tufting machine having means for supporting a base fabric for longitudinal movement in a feeding direction from front-to-rear through the machine and a plurality of needles spaced transversely of said feeding direction and adapted to reciprocate through the base fabric, a looper apparatus, comprising:

(a) a loop pile hook for each needle having a rearward projecting bill, (b) a needle plate finger for each needle having a finger portion, (c) mounting means supporting said finger on a corresponding hook so that said finger portion is above and spaced transversely of said bill of said corresponding hook, (d) said finger portion having an upper bearing surface supporting the base fabric moving in said feeding direction above said hook.

11. The invention according to claim 10 in which said finger comprises a neck portion, said mounting means supporting said neck portion behind said hook, and said finger portion projecting forward from said neck portion beside said corresponding bill.

12. The invention according to claim 11 in which said upper bearing surface is arcuate convex upward.

* * * * *